US011987912B2

(12) United States Patent
Poulsen et al.

(10) Patent No.: US 11,987,912 B2
(45) **Date of Patent: *May 21, 2024**

(54) UPPER FOR AN ARTICLE OF FOOTWEAR WITH A LATTICE STRUCTURE

(71) Applicant: NIKE, Inc., Beaverton, OR (US)

(72) Inventors: Monica M. Poulsen, Hillsboro, OR (US); Erin C. Stevens, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/875,220

(22) Filed: Jul. 27, 2022

(65) Prior Publication Data

US 2022/0364278 A1 Nov. 17, 2022

Related U.S. Application Data

(63) Continuation of application No. 16/397,138, filed on Apr. 29, 2019, now Pat. No. 11,408,102.
(Continued)

(51) Int. Cl.
*D04B 1/10* (2006.01)
*A43B 1/04* (2022.01)
(Continued)

(52) U.S. Cl.
CPC ..... *D04B 1/104* (2013.01); *A43B 1/04* (2013.01); *A43B 23/0265* (2013.01); *D04B 1/12* (2013.01); *D10B 2501/043* (2013.01)

(58) Field of Classification Search
CPC . D04B 1/24; D04B 1/22; D04B 1/106; D04B 1/104; A43B 1/04
See application file for complete search history.

(56) References Cited

U.S. PATENT DOCUMENTS 3,775,960 A 12/1973 Ogawa et al.
4,071,502 A 1/1978 Sugiyama et al.
(Continued)

FOREIGN PATENT DOCUMENTS

CN 204181063 U 3/2015
CN 106136418 A 11/2016
(Continued)

OTHER PUBLICATIONS

Partial European Search Report received for European Patent Application No. 23163173.0, dated Jul. 7, 2023, 13 pages.
(Continued)

*Primary Examiner* — Danny Worrell
(74) *Attorney, Agent, or Firm* — Shook, Hardy & Bacon L.L.P.

(57) ABSTRACT

An upper for an article of footwear may have a knitted component, where the knitted component has a first edge extending from a first side of a throat area of the upper, through a heel area of the upper, and to a second side of the throat area. At least a portion of the first edge may include a lattice structure, the lattice structuring having a first lattice band and a second lattice band, the first lattice band and the second lattice band having loops that are intermeshed in at least one location, where a plurality of first openings are located between the first lattice band and the second lattice band. At least one of the lattice bands may include a yarn having a tenacity of at least 5 g/d, and/or the first and second lattice bands may be formed from separate yarns.

20 Claims, 6 Drawing Sheets

Related U.S. Application Data

(60) Provisional application No. 62/664,483, filed on Apr. 30, 2018.

(51) Int. Cl.
*A43B 23/02* (2006.01)
*D04B 1/12* (2006.01)

(56) References Cited

U.S. PATENT DOCUMENTS

| | | | | |
|---|---|---|---|---|
| 5,173,231 | A | 12/1992 | Holland | |
| 6,449,879 | B1 | 9/2002 | Fallon et al. | |
| 7,204,042 | B2 | 4/2007 | Aveni | |
| 10,143,260 | B2 | 12/2018 | Mallen et al. | |
| 11,408,102 | B2 * | 8/2022 | Poulsen | A43B 23/0235 |
| 2002/0083621 | A1 | 7/2002 | Durocher | |
| 2014/0290095 | A1 | 10/2014 | Heard | |
| 2016/0033108 | A1 | 2/2016 | Ji et al. | |
| 2017/0311672 | A1 | 11/2017 | Hipp et al. | |
| 2018/0042333 | A1 | 2/2018 | Manos-gully et al. | |
| 2019/0328075 | A1 | 10/2019 | Poulsen et al. | |

FOREIGN PATENT DOCUMENTS

| | | | |
|---|---|---|---|
| CN | 106687003 | A | 5/2017 |
| DE | 2502574 | A1 | 7/1975 |
| WO | 97/09476 | A2 | 3/1997 |
| WO | 2016/187128 | A1 | 11/2016 |
| WO | 2018/009368 | A1 | 1/2018 |
| WO | 2018/031616 | A1 | 2/2018 |

OTHER PUBLICATIONS

Intention to Grant received for European Patent Application No. 19722467.8, dated Oct. 7, 2022, 7 pages.
Extended European Search Report received for EP Patent Application No. 23163173.0, mailed on Feb. 2, 2024, 15 pages.

* cited by examiner

UPPER FOR AN ARTICLE OF FOOTWEAR WITH A LATTICE STRUCTURE

CROSS-REFERENCE TO RELATED APPLICATIONS

This application is a continuation of U.S. patent application Ser. No. 16/397,138, filed Apr. 29, 2019, and titled "Upper for an Article of Footwear with a Lattice Structure," now issued as U.S. Pat. No. 11,408,102, which claims priority to U.S. provisional patent app. No. 62/664,483, filed Apr. 30, 2018, and titled "Upper for an Article of Footwear with a Lattice Structure," both of which are incorporated herein by reference in the entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF SUMMARY

One general aspect of the present disclosure includes an upper for an article of footwear, the upper including a knitted component, where the knitted component has a first edge extending from a first side of a throat area of the upper, through a heel area of the upper, and to a second side of the throat area. At least a portion of the first edge may include a lattice structure, the lattice structuring having a first lattice band and a second lattice band, the first lattice band and the second lattice band having loops that are intermeshed in at least one location, where a plurality of first openings are located between the first lattice band and the second lattice band. At least one of the lattice bands may include a yarn having a tenacity of at least 5 g/d.

Another general aspect of the present disclosure includes an upper for an article of footwear, the upper including a knitted component, where the knitted component has an edge extending from a first side of a throat area of the upper, through a heel area of the upper, and to a second side of the throat area. At least a portion of the edge of the knitted component may include a lattice structure, the lattice structure having a first lattice band and a second lattice band, the first lattice band and the second lattice band having a common knit structure, where a plurality of first openings are located between the first lattice band and the second lattice band. The first lattice band may be formed with a first yarn, where the second lattice band is formed with a second yarn, and where the first yarn is separate from the second yarn.

Another general aspect of the present disclosure includes a knitted component with a lattice structure. The lattice structure may include a first lattice band, a second lattice band, and a third lattice band, where a set of first openings is located between the first lattice band and the second lattice band, where a set of second openings is located between the second lattice band and the third lattice band, where the first lattice band and the second lattice band include at least one common knit structure, where the second lattice band and the third lattice band include at least one common knit structure, where at least one yarn forming the first lattice band is excluded from the second lattice band, and where at least one yarn forming the second lattice band is excluded from the third lattice band.

Another general aspect of the present disclosure includes a method. The method may include the steps of knitting a first portion of a lattice structure, where knitting the first portion of the lattice structure includes knitting a first lattice band, a second lattice band, and a third lattice band, where the first and second lattice bands have intermeshed loops in the first portion, and where a first opening is located between the second and third lattice bands in the first portion; and knitting a second portion of the lattice structure, where knitting the second portion of the lattice structure includes knitting the first lattice band, the second lattice band, and the third lattice band, where a second opening is located between the first and second lattice bands in the second portion, and where the second and third lattice bands have intermeshed loops in the second portion.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate.

DETAILED DESCRIPTION

Figure 1:
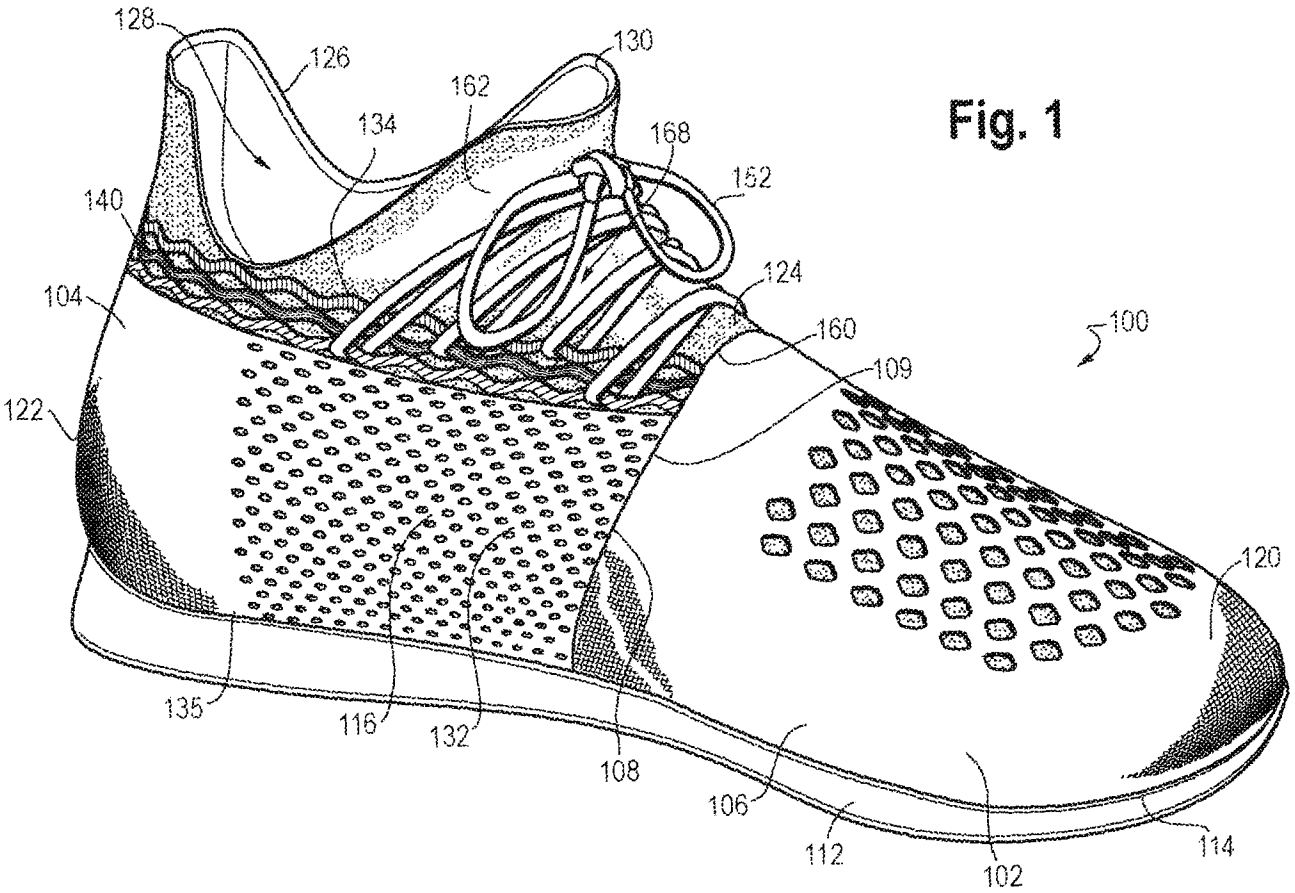
FIG. 1 is an illustration showing a perspective view of an article of footwear, the article of footwear including a lattice structure in accordance with certain aspects of the present embodiments.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

Figure 2A:
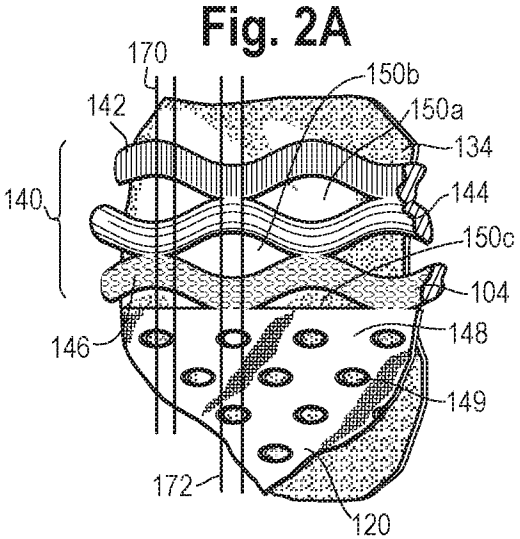
FIG. 2A is an illustration showing a magnified view of a lattice structure having three lattice bands, where the lattice bands are formed with yarns having different characteristics in accordance with certain aspects of the present disclosure.
Figure 2B:
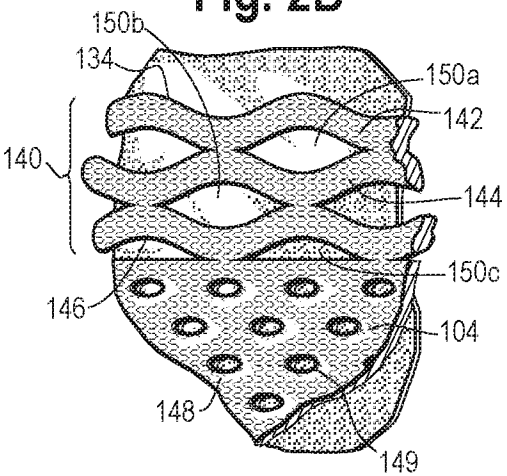
FIG. 2B is an illustration showing a magnified view of a lattice structure having three lattice bands and a base knit structure formed from a common yarn type in accordance with certain aspects of the present disclosure.
Figure 2:
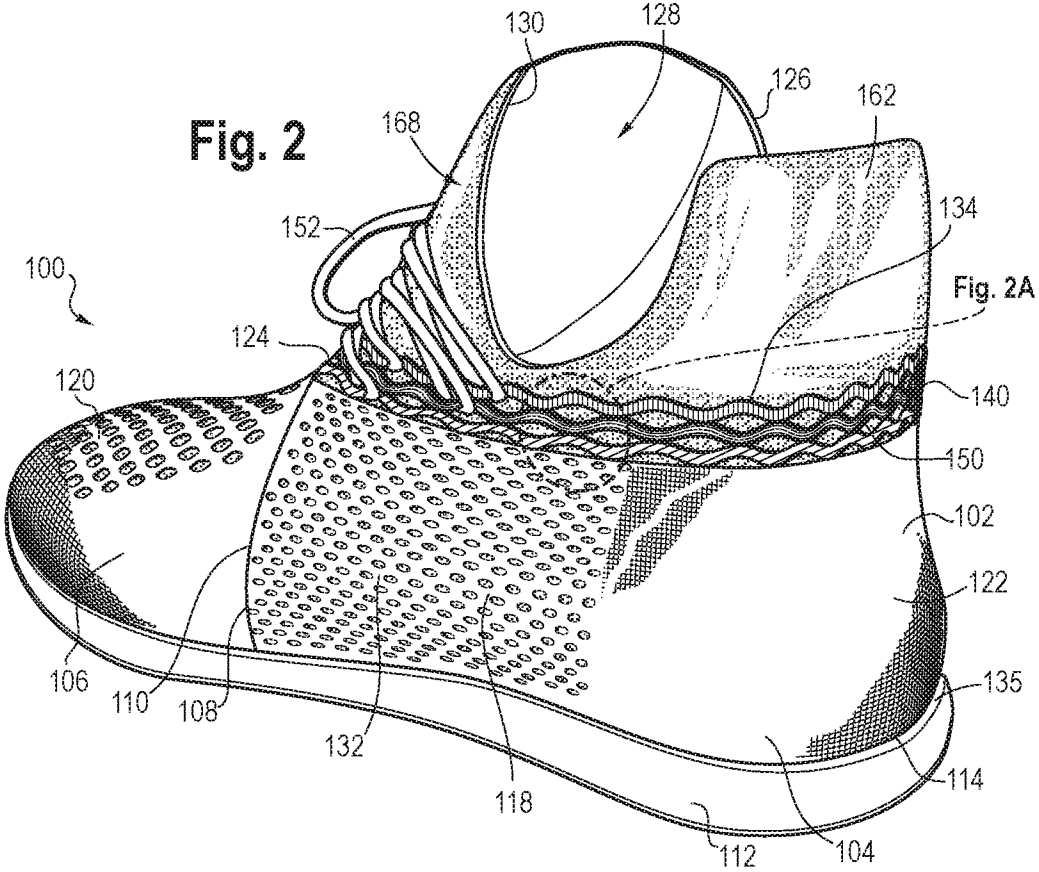
FIG. 2 is an illustration showing another perspective view of the article of footwear depicted in FIG. 1.

FIGS. 1-2 are illustrations showing different perspective views of an article of footwear 100. As shown, the article of footwear 100 may include an upper 102 that is partially or fully formed with at least one knitted component, such as a first knitted component 104 and a second knitted component 106. The first knitted component 104 and the second knitted component 106 may be secured together at a seam 108. The seam 108 may be formed by sewing the knitted components together, using an adhesive, using a mechanical clamp or another mechanical device (e.g., a stable), or through any other suitable device or method. The seam 108 may have two parts: a first portion 109 located on a lateral side 116 (shown in FIG. 1) and a second portion 110 located on a medial side 118 (shown in FIG. 2).

The upper 102 may be secured to a sole structure 112. The area where the sole structure 112 joins the upper 102 may be referred to as a biteline 114. The upper 102 may be joined to the sole structure 112 in a fixed manner using any suitable technique, such as through the use of an adhesive, by sewing, etc. The upper 102 may extend partially or completely around a foot of a wearer (e.g., under the foot) and/or may be integral with the sole structure 112, and a sockliner may or may not be used. In some embodiments, the sole structure 112 may include a midsole and an outsole.

The upper 102 may include a lateral side 116, a medial side 118, a toe area 120, and a heel area 122. The upper 102 may additionally include a throat area 124 extending from an ankle opening 126 leading to a void 128, and a collar 130 may at least partially surround the ankle opening 126. The void 128 of the article of footwear 100 may be configured (e.g., sized and shaped) to receive and accommodate a foot of a person. The throat area 124 may be generally disposed in a midfoot area 132 of the upper 102, which may be located between the heel area 122 and a toe area 120. In some embodiments, a tongue (not shown) may be disposed at least partially in the throat area 124. If the tongue is included, the tongue may be any type of tongue, such as a gusseted tongue or a burrito tongue. If a tongue is not included, the lateral and medial sides of the upper 102 may be joined together. In the depicted embodiment, an exterior surface of the throat area 124 is formed by a liner 162, which is described in more detail below.

In addition to, or as an alternative to, the first knitted component 104 and/or the second knitted component 106, the upper 102 may be formed with textile materials formed by a process other than knitting (e.g., weaving) and/or other materials, such as leather, plastic, rubber, etc. However, in non-limiting exemplary embodiments, forming the upper 102 with knitted materials may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. Forming the upper 102 with knitted material may also provide desirable aesthetic characteristics by incorporating yarns having different colors, textures or other visual properties arranged in a particular pattern.

The first knitted component 104 (including the lattice structure 140), and/or the second knitted component 106, may be formed as an integral one-piece element during a single knitting process, such as a weft knitting process (e.g., with a flat knitting machine or circular knitting machine), a warp knitting process, or any other suitable knitting process. That is, the knitting process on the knitting machine may substantially form the knit structure of the first knitted component 104 and/or the second knitted component 106 without the need for significant post-knitting processes or steps. Alternatively, two or more portions of the first knitted component 104 and/or the second knitted component 106 may be formed separately as distinct integral one-piece elements and then the respective elements attached. In some embodiments (not shown), it is contemplated that a single knitted component may be included (e.g., where the first knitted component 104 and the second knitted component 106 are combined as an integral one-piece element), and that single knitted component may form the majority of or the entirety of the upper 102. Further, while the depicted embodiment includes two knitted components, at least one of the first knitted component 104 and the second knitted component 106 may alternatively be formed of another textile material or a non-textile material.

In some embodiments, the types of yarns used to form the first knitted component 104 and/or the second knitted component 106 may be varied at different locations such that the first knitted component 104 and/or the second knitted component 106 has areas with different properties (e.g., a portion forming the throat area 124 of the upper 102 may be relatively elastic while another portion may be relatively inelastic). Additionally or alternatively, in some embodiments, the first knitted component 104 and/or the second knitted component 106 may incorporate one or more materials with properties that change in response to a stimulus (e.g., temperature, moisture, electrical current, magnetic field, or light). For example, at least one of the first knitted component 104 and the second knitted component 106 may include yarns formed of one or more thermoplastic polymer materials (including material composites) that transition from a solid state to a softened or liquid state when subjected to certain temperatures at or above the melting point and then transitions back to a solid state when cooled. The thermoplastic polymer material(s) may provide the ability to heat and then cool a portion of the knitted material to thereby form an area of bonded or continuous material (herein referred to as a "fused area") that exhibits certain advantageous properties including a relatively high degree of rigidity, strength, and water resistance, for example. Non-limiting examples of thermoplastic polymer materials are polyurethanes, polyamides, polyolefins, and/or certain nylons.

The first knitted component 104 may have a first edge 134 (or top edge) that extends along the throat area 124 on the lateral side 116 of the upper 102, around the ankle area and through the heel area 122 of the upper 102, and then along the throat area 124 on the medial side 118 of the upper 102 (or vice versa). A lattice structure 140 may extend along the first edge 134, and therefore the lattice structure 140 may also extend from the throat area 124 on the lateral side 116, around the heel area 122, and to the throat area 124 on the medial side 118 of the upper 102 (or vice versa). A second edge 135 of the first knitted component 104 may extend along the biteline 114. An edge 160 may define the forward edge, or front, of the throat area 124.

A magnified view of the lattice structure 140 is shown in FIG. 2A. As depicted, the lattice structure 140 may include one or more lattice bands (such as a first lattice band 142, and second lattice band 144, and a third lattice band 146). As described in more detail below, the three lattice bands may be formed together on a knitting machine such that the first lattice band 142 has at least one common knit structure with the second lattice band 144 (e.g., they may have at least one common yarn, knitted loops that intermesh, etc.), and similarly such that the second lattice band 144 has a common knit structure with the third lattice band 146. The third lattice band 146 may have a common knit structure with a base knit structure 148. In other words, they may be formed together on a knitting machine as an integral one-piece component such that they are secured together when leaving the knitting machine, and without the need for post-knitting securement. While the lattice bands may have any suitable width (e.g., a cross-sectional dimension perpendicular to the longitudinal direction of the lattice bands), in certain embodiments, the first lattice band 142, the second lattice band 144, and/or the third lattice band 146 have a width of between about two knit loops/stitches to about ten knit loops/stitches, such as about three knit loops/stitches. This may correspond with a width of between about 1/16" to about 1", such as about 3/16" (which may vary depending on the loop and yarn size(s)). Further, one of more of the lattice bands may vary in width along its respective length, and/or one of the lattice bands may be wider than another.

More or less than three lattice bands may be included, as desired. In some embodiments, it is contemplated that the majority of the first knitted component 104, or even all of the first knitted component 104, may be formed with similar lattice bands. Further, in the depicted embodiment, each of the first lattice band 142, the second lattice band 144, and the third lattice band 146 extends along the entirety of the first edge 134 (and thus all the way around the back of the upper 102 as shown in FIGS. 1-2), but it is also contemplated that at least one of the lattice bands may terminate at some point along the first edge 134.

In some embodiments, the lattice bands may include different yarns, thus giving one or more of the lattice bands different physical and/or aesthetic properties. For example, as illustrated in FIG. 2A (e.g., by a different surface texture for illustration purposes only), the first lattice band 142 may have a different yarn color than the second lattice band 144. That is, the first lattice band 142 may be formed by yarns having a first color, the second lattice band 144 may be formed by yarns having a second color, and the first color and the second color may be different. It is also contemplated that the physical characteristics of the yarn(s) forming the first lattice band 142 may be different than the physical characteristics of the yarn(s) forming the second lattice band 144. For example, the yarns of the first lattice band 142 may be more elastic than the yarns of the second lattice band 144 such that, after formation, the first lattice band 142 is more elastic than the second lattice band 144. The ability to form the lattice bands with different yarns (e.g., where a yarn of one lattice band is substantially excluded from another) is provided by the methods described below, including the knitting sequences illustrated in FIGS. 5-6.

As illustrated by FIG. 2B, the first knitted component 104 may alternatively be formed such that the different elements of the lattice structure 140 have similar or identical yarn(s) and knit structures throughout such that, per unit area, the aesthetic and physical characteristics of the first lattice band 142, the second lattice band 144, the third lattice band 146, and the base knit structure 148 are about the same. This may be advantageous where a particular yarn type is optimal for forming all of the lattice structure 140, where common visual characteristics are desired, etc.

Referring to FIGS. 2A-2B, a plurality of openings 150 may be formed by the lattice structure 140. In particular, a set of first openings 150*a* may be located between the first lattice band 142 and the second lattice band 144, a set of second openings 150*b* may be located between the second lattice band 144 and the third lattice band 146, and a set of third openings 150*c* may be located between the third lattice band 146 and the base knit structure 148. The openings 150 may all be about the same size or may have varying sizes. In certain embodiments, the length of the openings 150 (measured in the direction extending along the first edge 134) may be between about three knit courses of a lattice band to about twenty-five knit courses of a lattice band, such as about ten knit courses in certain exemplary embodiments (for example). This may correspond to a length of about 1/4" to about 2", such as about 1/2". Larger or smaller lengths are also contemplated, as desired.

The base knit structure 148 may have any suitable knit structure. In some embodiments, the base knit structure 148 may have any suitable double or single jersey knit structure, for example, and the specific knit structure(s) may be selected for providing desirable physical or aesthetic characteristics. In some embodiments, the base knit structure 148 may include a plurality of apertures 149 for purposes of breathability, stretchability (of the base knit structure 148), decreased weight of the first knitted component 120, etc. It is contemplated that the apertures 149 may be formed by a particular knit structure (e.g., rather than being formed after knitting), and in some embodiments, the apertures 149 may be formed with a knitting sequence that is similar or identical to the way the openings 150 of the lattice structure 140 are formed.

Referring back to FIGS. 1-2, the openings 150 provided by the lattice structure 140 may have a variety of functions. For example, the openings 150 may provide apertures that communicate with a fastening element, such as a shoelace or another suitable device (e.g., a Velcro strap, a ratchet mechanism, etc.). Herein, a shoelace 152 is the only element shown and described as the fastening system, but the following features also apply to fastening systems of other types. In some embodiments, at least some of the openings 150 may have selected sizes for adequate communication with the shoelace 152, while others may not. For example, when the article of footwear 100 is designed to be fastened in a particular way (e.g., from certain locations along the edge 134 for optimal performance), certain openings 150 may be positioned and sized (e.g., sized larger than other openings 150) such that it is apparent to a user which openings 150 are intended to communicate with the shoelace 152.

In some embodiments, many or all of the openings 150 (including at least two adjacent openings) may be about the same size, or at least adequately sized for communication with the shoelace 152, such that a user can select which openings 150 are used. For example, the shoelace 152 of FIGS. 1-2 extends through at least one opening from each of the first openings 150*a*, the second openings 150*b*, and the third openings 150*c*. The ability to select and utilize any of the openings 150 for communication with the shoelace 152 may provide customized and/or enhanced aesthetics (e.g., which may be selected by the user per personal preference). This embodiment may also be advantageous where certain shoelace configurations are desirable for certain sports/functions (e.g., one configuration may be optimal for providing high performance while running and another configuration may be more comfortable while walking), etc. Further, different users may prefer different shoelace configurations based on foot sizing and/or personal taste.

Figure 3:
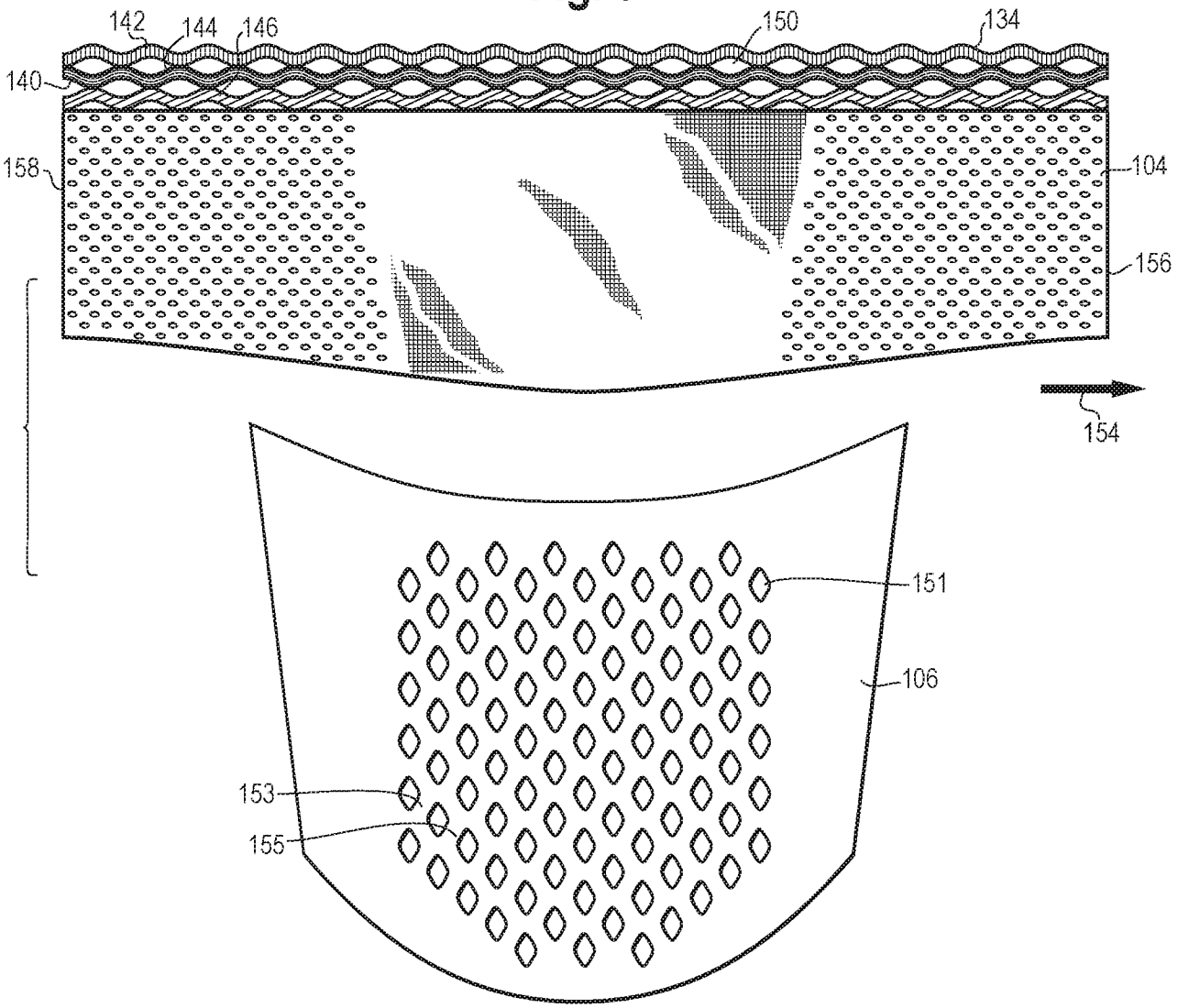
FIG. 3 is an illustration showing a first knitted component and a second knitted component after a knitting process and prior to being manipulated into a wearable shape in accordance with certain aspects of the present disclosure.

FIG. 3 shows the first knitted component 104 and the second knitted component 106 as they may appear when in a flat configuration after formation on a knitting machine, and prior to being secured together and manipulated into a wearable shape. In non-limiting exemplary embodiments, the first knitted component 104 may be knitted in the direction shown with arrow 154 (that is, as the first knitted component 104 is knitted, the courses may extend from a lateral edge 156 to a medial edge 158 and thus the first knitted component 104 may grow along the first edge 134). One example of a particular knitting process for forming the first knitted component 104 is described in more detail below (with reference to FIGS. 5-6).

The second knitted component 106 be formed to have features desirable in a toe area of an article of footwear. For example, the second knitted component 108 may have a relatively robust knit structure (e.g., a full double-jersey structure) to provide protection of the toes, durability in the toe area, and the like. Optionally, the second knitted component 108 may include the depicted apertures 151. It is contemplated that the apertures 151 may be formed by a particular knit structure (e.g., rather than being formed after knitting), and in some embodiments, the apertures 151 may be formed with a knitting sequence that is similar or identical to the way the openings 150 of the lattice structure 140 are formed. For example, a first portion 153 of the second knitted component 108 may be a lattice band (similar to the lattice bands 142, 144, 146), a second portion 155 of the second knitted component 108 may be a second lattice band, and a set of the apertures 151 may be located therebetween (in a manner similar to how the openings 150 are oriented within the lattice structure 140).

Figure 4:
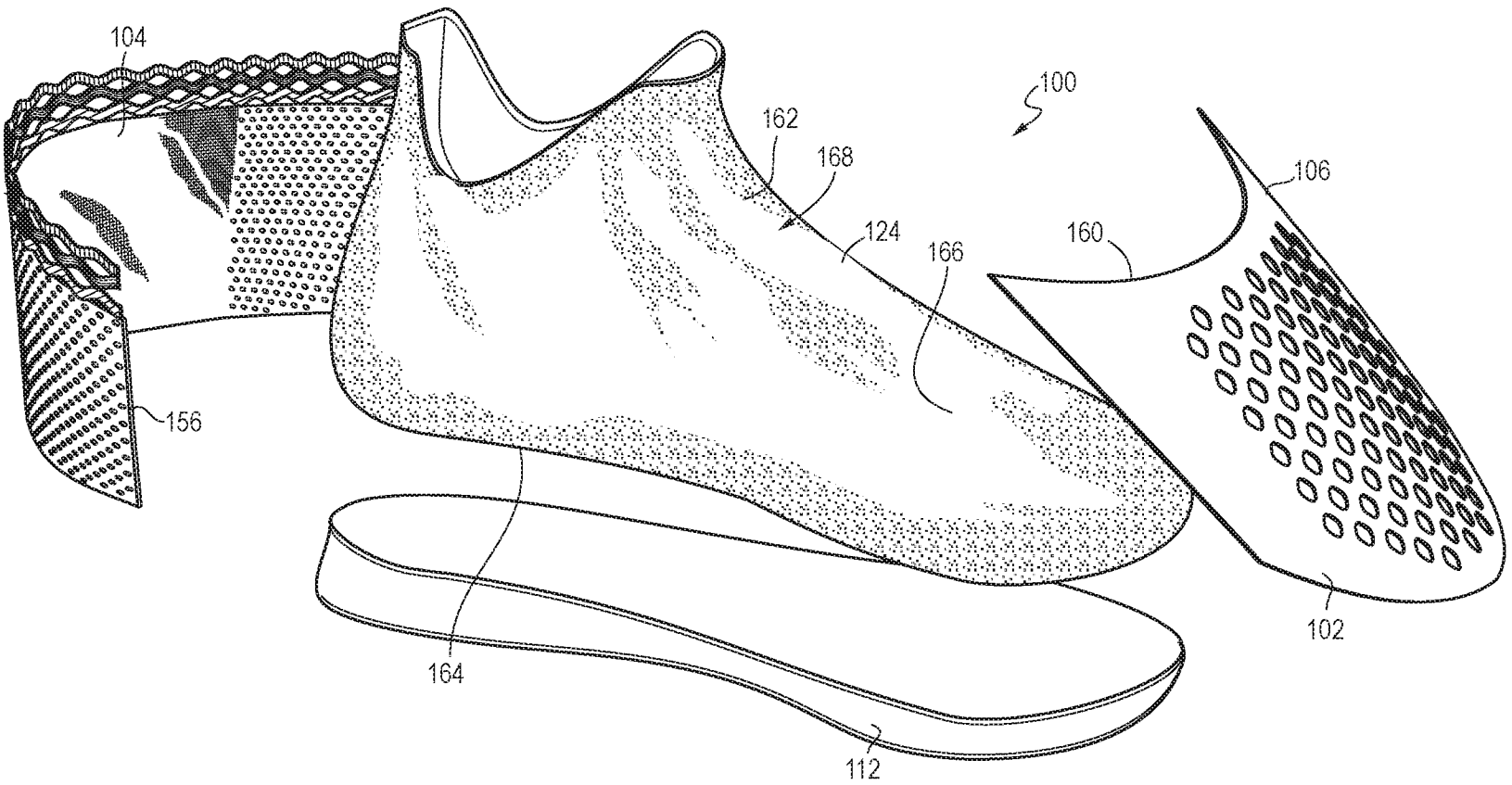
FIG. 4 is an illustration showing an exploded view of certain elements of the article of footwear of FIGS. 1-2.

As shown in FIG. 4, the first knitted component 104 and the second knitted component 106 may be assembled into the upper 102 by engaging the lateral edge 156 of the first knitted component 104 with an edge 160 of the second knitted component 106 (e.g., at the first portion 109 of the seam 108 shown in FIG. 1). Similarly, the medial edge 158 (see FIG. 3) of the first knitted component 104 may be secured to the edge 160 of the second knitted component 106 (e.g., at the second portion 110 of the seam 108 shown in FIG. 2). Once engaged, the seam 108 may be formed by sewing, applying an adhesive, stapling, or with any other suitable device and by any other suitable method. The upper 102 may then (or simultaneously) be lasted and secured to a sole structure 112 (e.g., with or without the use of a strobel, which is not shown). FIG. 4 may not include all elements of the article of footwear 100 for ease of illustration (e.g., it may be missing a strobel, a midsole, etc.). The liner 162, when included, may be inserted in the void of the upper 102 after the upper 102 is formed, or it may be integrated into the article of footwear 100 prior to full formation of the upper 102.

The liner 162 may advantageously enhance cushioning, fit, warmth, or other desirable characteristics. If the liner 162 is not secured with respect to another component, the liner 162 may be insertable and removable by a user, which may be advantageous where the user may want to clean the liner 162, change liners based on wear, aesthetic appeal, comfort preferences, proper sizing, etc. In other embodiments, the liner 162 may be secured to at least one of the upper 102 and the sole structure 112 such that it is not readily removable, which may be advantageous to enhance the durability of the article of footwear 100, to prevent the liner 162 from sliding with respect to other components of the article of footwear 100, etc. In some embodiments, the liner 162 may be a knitted component, but it may alternatively be at least partially formed by materials other than knitted materials in other embodiments. While not required, the liner 162 extends completely around the foot of a wearer, and thus it may include an underfoot portion 164 (see FIG. 4) that may be associated with a plantar aspect of the foot (also known as the sole or bottom of a foot). The portion of the liner 162 associated with the remainder of the foot, including the dorsal surface (i.e., the top of the foot), may be considered an overfoot portion 166. While not shown (and not required), the first knitted component 104 and/or the second knitted component 106 may additionally or alternatively include an underfoot portion.

In some embodiments, including the embodiment of FIGS. 1-4, the liner 162 may have an exposed surface 168 that forms a portion of an outer surface of the article of footwear (e.g., where the liner 162 is not covered by the first knitted component 104 or the second knitted component 106 from an external perspective). For example, referring to FIGS. 1-2, the liner 162 may have an exposed surface in the throat area. This may be advantageous to provide coverage of the dorsal (top) surface of the foot without requiring a tongue. Further, coverage in the throat area 124 by the liner 162 may prevent the shoelace 152 or other fastening element from contacting and irritating the skin of the foot.

Figure 5:
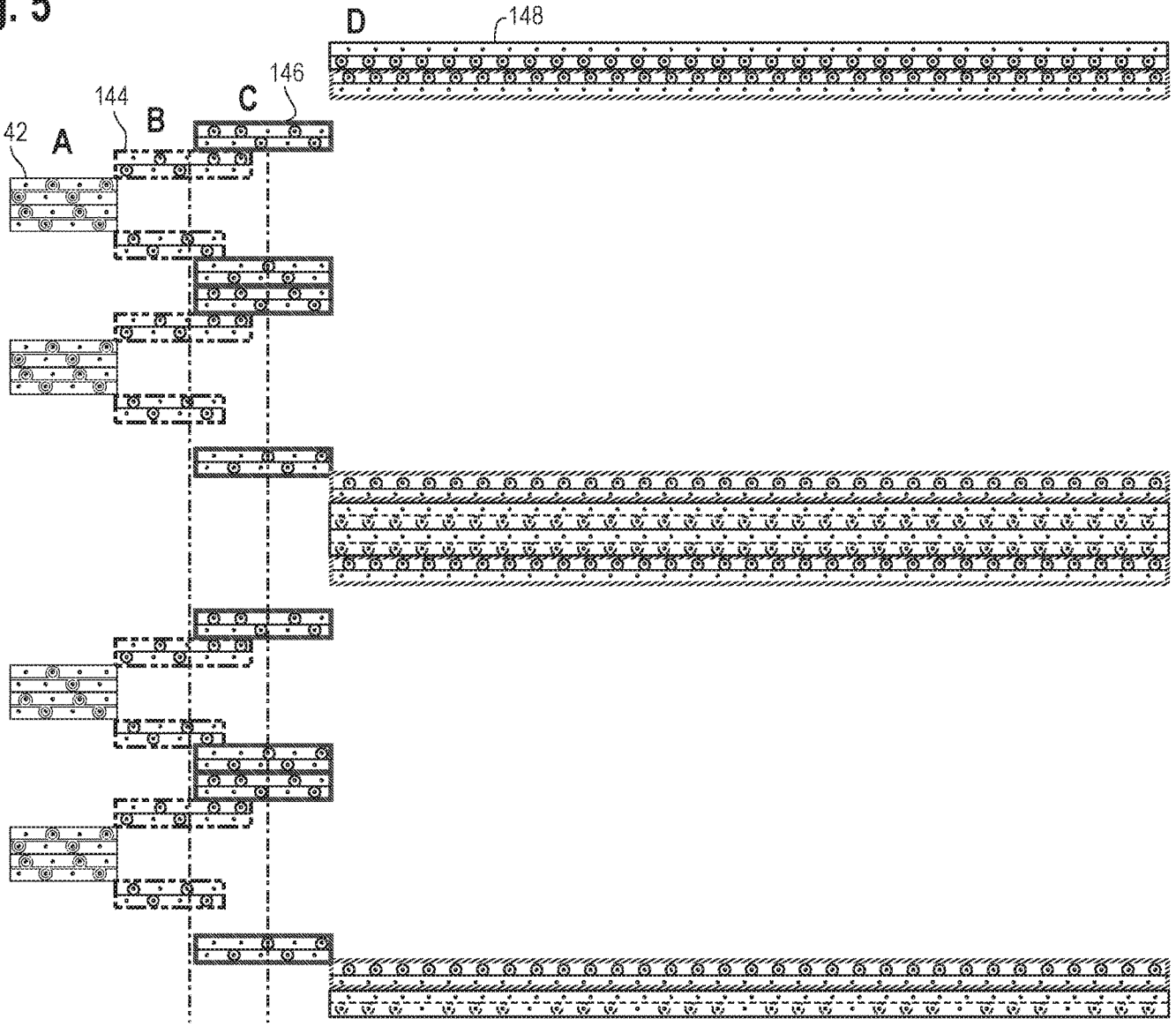
FIGS. 5-6 are illustrations with diagrams representing first and second sequences of knitting steps for respectively forming a first portion of a knitted lattice structure and a second portion of a knitted lattice structure in accordance with certain aspects of the present disclosure.
Figure 6:
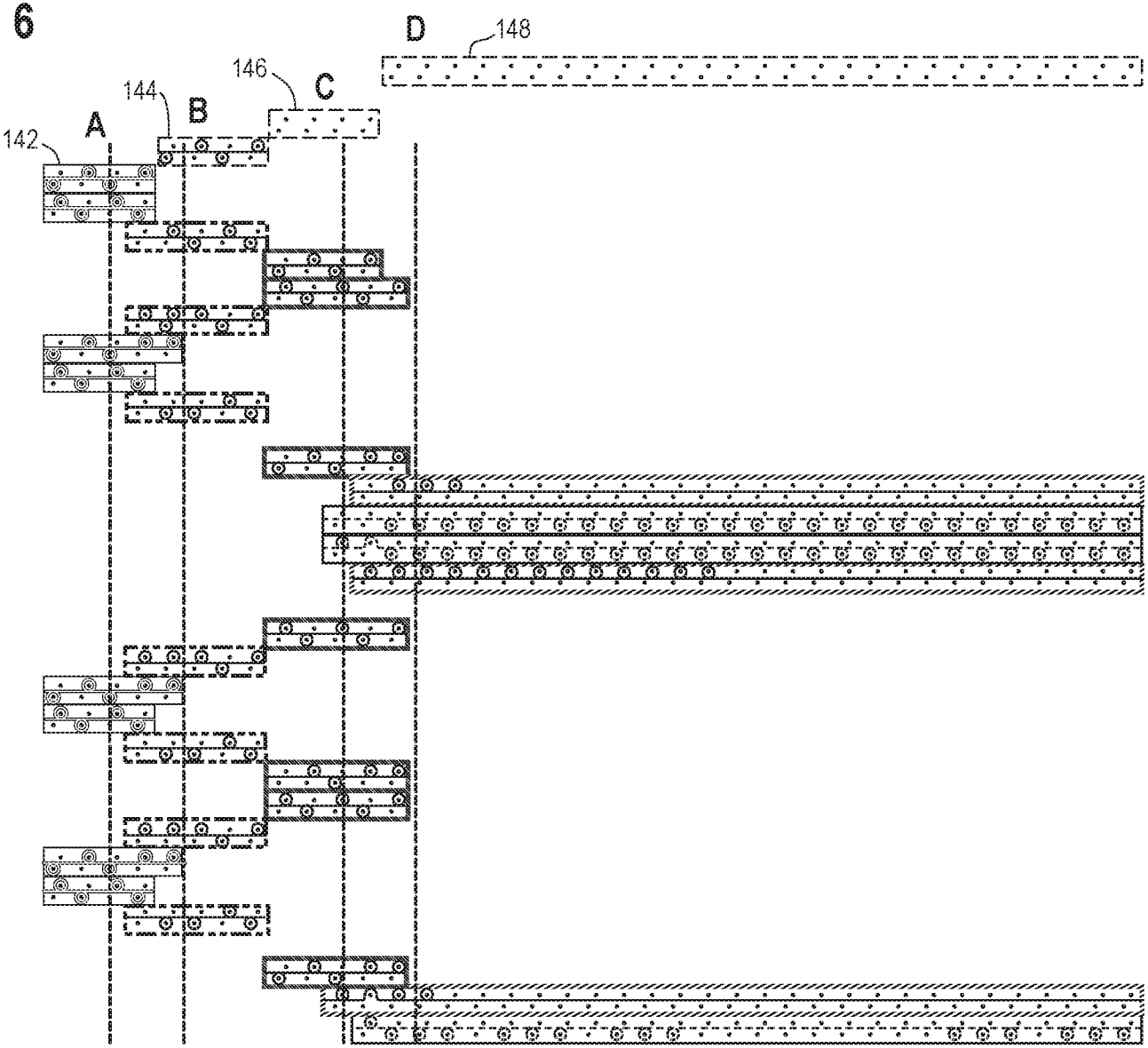

FIGS. 5-6 are illustrations showing sequences for knitting portions of the lattice structure 140 of FIGS. 1-4. The sequence of FIG. 5 may alternate with the sequence of FIG. 6 a number of times, and each repetition of the sequence of FIG. 5 and of FIG. 6 may be the same or have only minor alterations. However, it is noted that the sequences may be varied to incorporate different features by changing certain knit structures, by varying yarn types, by increasing or decreasing the number of courses at each step, or by any other suitable adjustment to the knitting process or materials used. Further, other sequences may be used before, after, or between the sequences of FIG. 5 and FIG. 6.

FIG. 5 depicts a sequence for forming an area (i.e., area 170 shown in FIG. 2A) where an opening is formed between the first lattice band 142 and the second lattice band 144, where the second lattice band 144 and the third lattice band 146 are connected (e.g., via interlooped yarns such that they have a common knit structure), and where an opening is formed between the third lattice band 146 and the base knit structure 148. In FIG. 5 (and also FIG. 6), yarns A correspond to the first lattice band 142, yarns B correspond to the second lattice band 144, yarns C correspond to the third lattice band 146, and yarns D correspond to the base knit structure 148. While the yarn(s) are depicted as being different yarn types (e.g., due to different texture coding in FIGS. 5-6), they may be yarns of the same type.

In particular, loops forming the second lattice band 144 overlap loops forming the third lattice band 146 in the knit diagram, meaning those overlapping loops are formed on the same needles of a knitting machine (and it is noted that consecutive loops on the same needle will become intermeshed). However, in FIG. 5, the first lattice band 142 does not have loops that overlap loops of the second lattice band 144, and therefore the first lattice band 142 will be separable with respect to the second lattice band 144. An opening is therefore formed therebetween. It is noted that, while not shown, the first lattice band 142 may be spaced from the second lattice band 144 on the needle bed of the knitting machine to increase the size (e.g., width) of the opening. Similarly, the third lattice band 146 does not have loops that will intermesh with the loops of the base knit structure 148, and therefore an opening will be formed between those elements.

FIG. 6 is an illustration showing another portion of a knitting sequence for knitting the lattice structure 140 of FIGS. 1-4. In particular, FIG. 6 depicts forming an area (i.e., area 174 shown in FIG. 2A) where the first lattice band 142 and the second lattice band 144 are connected (e.g., via intermeshed loops such that they have a common knit structure), where an opening is formed between the second lattice band 144 and the third lattice band 146, and where the third lattice band 146 is connected to the base knit structure (e.g., via intermeshed loops such that they have a common knit structure).

In particular, loops forming the first lattice band 142 overlap loops forming the second lattice band 144 in the knit diagram, meaning those overlapping loops are formed on the same needles of a knitting machine (such that they will become intermeshed). Similarly, loops forming the third lattice band 146 overlap loops forming the base knit structure 148, meaning those overlapping loops are formed on the same needles of a knitting machine (such that they will become intermeshed). However, in FIG. 6, the second lattice band 144 does not have loops that overlap loops of the third lattice band 146, and therefore the second lattice band 144 will be separable with respect to the third lattice band 146 such that an opening is formed therebetween (and it is noted that, while not shown, the second lattice band 144 may be spaced from the third lattice band 146 on the needle bed to increase the size (e.g., width) of the opening.

In one of more of the lattice bands, more than one yarn type may be used (and it is noted that each of yarns A, B, C, D in the knit diagrams may represent multiple ends of one or more yarn types). For example, at least one of the yarns in a lattice band and/or the base knit structure may be considered to be a "high-tenacity yarn," which may be particularly advantageous when the lattice structure must be rigid enough and strong enough to communicate with a fastening system to tighten the upper around the foot. As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, MA, USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities (e.g., a "high tenacity yarn") generally have tenacities in the range of about 5 g/D to about 10 g/D. For example, commercially available package dyed polyethylene terephthalate filament yarn from National Spinning (Washington, NC, USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, NC, USA) and Spectra (Honeywell-Spectra, Colonial Heights, VA, USA).

Additionally or alternatively, one or more of the yarns in a lattice band and/or the base knit structure may incorporate what is referred to as a "fusible yarn." A fusible yarn may include a material, such as a thermoplastic polymer material, that has a melting point such that it can be at least partially melted during the manufacturing process. Herein, a yarn may be considered a "fusible yarn" if it has a melting point of less than about 170° C. Illustrative, non-limiting examples of thermoplastic polymer materials include certain polyurethanes, polyamides, polyolefins, nylons, copolyamides and copolyesters. Thermoplastic polymer materials may melt when heated and return to a solid state when cooled. More particularly, thermoplastic polymer material transitions from a solid state to a softened or liquid state when subjected to temperatures at or above its melting point, and then the thermoplastic polymer transitions from the softened or liquid state to a solid state when sufficiently cooled below its melting point. In certain non-limiting embodiments, the fusible yarn may be formed of a copolymid or copolyester with a melting point of less than about 80° C. (such as about 60° C. in certain non-limiting exemplary embodiments), which may be a suitable melting temperature such that the fusible yarn can be at least partially melted during a steaming process (e.g., during lasting) without melting, scorching, or otherwise changing the characteristics of other yarns with higher melting points (e.g., polyester yarns). One specific example is a KE-60 167 dtex Fusible Yarn obtained from EMS (Domat/Ems, Switzerland). Once cooled, the material from the fusible yarn may solidify and enhance (e.g., stiffen, secure, or otherwise reinforce) the structure of the knitted component.

In some embodiments, a fusible yarn may be included, where the fusible yarn has a thermoplastic polymer sheath (e.g., formed of thermoplastic polyurethane) and a core formed of another material with a substantially higher melting point, such as polyester. For example, the melting temperature of the thermoplastic polymer material may have a melting temperature of approximately 100° C. less than the melting temperature of the core in some embodiments, though any other suitable difference in melting temperatures is contemplated. In one non-limiting example, the melting temperature of the core may be about 260° C. (and when the core is formed of a thermoset material, the decomposition temperature may be about 350° C. or greater), while the melting temperature of the thermoplastic polymer material may be between about 80° C. and about 140° C. (such as from about 100° C. to about 125° C.) based on atmospheric pressure at sea level.

In addition to, or as an alternative to, the yarn types above, one or more of the yarns in a lattice band and/or the base knit structure may include a yarn formed 100% polyester, or having a content of polyester along with another material (e.g., Lycra) to enhance elasticity/stretchability or other characteristics. One specific example is a yarn referred to as a Using a yarn incorporating polyester may be particularly advantageous due to the comfortable surface characteristics associated with polyester, the ease of dying yarns formed of polyester (e.g., to provide yarns having selected colors and/or visual patters), and the ease of manufacturing on a knitting machine with polyester yarns.

All of the structures and methods disclosed and claimed herein can be made and executed without undue experimentation in light of the present disclosure. While this invention may be embodied in many different forms, there are described in detail herein specific aspects of the invention. The present disclosure is an exemplification of the principles of the invention and is not intended to limit the invention to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various aspects described herein. It should also be understood that various changes and modifications to the aspects described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A knitted component, comprising:

a lattice structure comprising a first lattice band, a second lattice band, and a third lattice band, wherein a first set of openings is located between the first lattice band and the second lattice band, wherein a second set of openings is located between the second lattice band and the third lattice band, wherein the first lattice band and the second lattice band include at least one common knit structure, and wherein the second lattice band and the third lattice band include at least one common knit structure.

2. The knitted component of claim 1, wherein at least one of the first lattice band, the second lattice band, and the third lattice band includes a yarn with a tenacity of at least 5 g/D.

3. The knitted component of claim 1, wherein at least one of the first lattice band, the second lattice band, and the third lattice band includes a yarn comprising a material that has a melting point of less than 80 degrees Celsius.

4. The knitted component of claim 1, wherein the first lattice band, the second lattice band, and the third lattice band are at least partially intermeshed.

5. The knitted component of claim 1, wherein the knitted component comprises a portion of an upper for an article of footwear.

6. The knitted component of claim 1, wherein the knitted component comprises part of an article of footwear.

7. An upper for an article of footwear, the upper comprising:

a knitted component comprising a lattice structure, the lattice structure comprising a first lattice band and a second lattice band, the first lattice band and the second lattice band having loops that are intermeshed in at least one location, and the first lattice band and the second lattice band extending continuously between a first side of a throat area of the upper and a second side of the throat area of the upper and around a heel area of the upper.

8. The upper of claim 7, wherein at least one opening is located between the first lattice band and the second lattice band.

9. The upper of claim 7, wherein a plurality of openings are located between the first lattice band and the second lattice band and between the loops that are intermeshed.

10. The upper of claim 7, wherein the first lattice band and the second lattice band are spaced from an edge extending around a collar of the upper.

11. The upper of claim 7, wherein the first lattice band and the second lattice band extend substantially perpendicular to a throat edge of the upper.

12. The upper of claim 7, wherein at least one of the first lattice band and the second lattice band includes a yarn with a tenacity of at least 5 g/D.

13. The upper of claim 7, wherein at least one of the first lattice band and the second lattice band includes a yarn comprising a material with a melting point of less than 80 degrees Celsius.

14. The upper of claim 7, wherein the upper comprises part of an article of footwear.

15. An upper for an article of footwear, comprising:

a knitted component, comprising:

a first side, a second side, a throat edge located on the first side and on the second side, a collar edge located on the first side and on the second side, a heel area located between the first side and the second side, and a lattice structure comprising a plurality of lattice bands that extend across the knitted component adjacent to the throat edge.

16. The upper of claim 15, wherein the plurality of lattice bands are at least partially intermeshed, and wherein the plurality of lattice bands are spaced from the collar edge.

17. The upper of claim 15, wherein the plurality of lattice bands extend continuously around the heel area of the knitted component.

18. The upper of claim 15, wherein the plurality of lattice bands extend adjacent to the heel area of the knitted component.

19. The upper of claim 15, wherein the plurality of lattice bands extend from the throat edge of the knitted component.

20. The upper of claim 15, wherein the upper comprises part of an article of footwear.

* * * * *